US005437558A

United States Patent [19]

Sakuraoka et al.

[11] Patent Number: 5,437,558

[45] Date of Patent: Aug. 1, 1995

[54] CONNECTOR HAVING SKIRT WITH HOLES TO RECEIVE PLUG PINS AND ALIGNMENT PIN

[75] Inventors: Masahiko Sakuraoka; Kouichi Hara; Kiyoshi Kuwabara; Misao Umematsu, all of Kawasaki, Japan

[73] Assignee: Fujitsu Limited, Kawasaki, Japan

[21] Appl. No.: 109,264

[22] Filed: Aug. 20, 1993

[30] Foreign Application Priority Data

Feb. 1, 1993 [JP] Japan ..... 5-014784

[51] Int. Cl.[6] ..... H01R 13/44

[52] U.S. Cl. ..... 439/140; 439/892

[58] Field of Search ..... 439/140, 141, 374, 378, 439/892

[56] References Cited

U.S. PATENT DOCUMENTS

| | | | |
|---|---|---|---|
| 3,651,444 | 3/1972 | Desso et al. | 439/141 |
| 4,797,116 | 1/1989 | Isohata et al. | 439/141 |
| 4,832,613 | 5/1989 | Tsukakoshi | 439/141 |
| 5,222,907 | 6/1993 | Katabuchi et al. | 439/892 X |

FOREIGN PATENT DOCUMENTS 4-112464 4/1992 Japan .

*Primary Examiner*—Kheim Nguyen

*Attorney, Agent, or Firm*—Staas & Halsey

[57] ABSTRACT

A connector comprising a plug member having pin-like male contacts and a jack member having female contacts, the jack member being coupled with the plug member by a plug-in connection. A skirt having a plurality of holes is arranged to hold the pin-like male contacts in position. The skirt is supported in the plug member by the locating groove-pin engagement. The locating groove-pin engagement is released by the jack member when the jack member is inserted into the plug member and reestablished by the jack member when the jack member is withdrawn from the plug member. The skirt also has an alignment pin which is received in a locating hole of the jack member when the jack member is inserted into the plug member. Therefore, it is possible to insert the jack member in the plug member without the pin-like male contacts being bent, as well as to easily withdraw the jack member from the plug member.

9 Claims, 4 Drawing Sheets

CONNECTOR HAVING SKIRT WITH HOLES TO RECEIVE PLUG PINS AND ALIGNMENT PIN

BACKGROUND OF THE INVENTION

1. Field of the Invention

The present invention relates to a connector comprising a plug member, a jack member, and a skirt to hold the free end portions of the pin-like male contacts of the plug member.

2. Description of the Related Art

Plug-in connectors comprising a plug member having a plurality of pin-like male contacts and a jack member having a plurality of female contacts are widely used. For example, in the interconnection between a printed wiring board and wiring cables, a plug member is attached to the printed wiring board and a jack member is attached to the cables, so that the plug member is coupled to the jack member by a plug-in connection. It is also possible to interconnect a printed wiring board to another printed wiring board by a connector comprising a plug member and a jack member. In computers, a mother board has plug members including pin-like male contacts to which jack members are coupled by a plug-in connection.

In coupling the jack member to the plug member by a plug-in connection, there is a possibility that the pin-like male contacts of the plug member may be bent if the pin-like male contacts are slightly distorted, or if the pin-like male contacts of the plug member are not exactly aligned with the female contacts of the jack member. If the pin-like male contacts of the plug member are bent, an electrical connection between the plug member and the jack member becomes incomplete. Recently, as the requirements of high density packaging have increased, the cross-sectional area and the pitch of the pin-like male contacts are becoming narrower. Therefore, the pin-like male contacts of the plug member are increasingly apt to be bent.

Japanese Unexamined Patent Publication (Kokai) No. 4-112464, for example, proposes to arrange a skirt to hold the free end portions of the pin-like male contacts of the plug member to prevent the pin-like male contacts from being bent when the jack member is inserted into the plug member. The skirt comprises a substantially flat plate having holes in correspondence with the pin-like male contacts of the plug member, and is movable upwardly and downwardly relative to the plug member with the pin-like male contacts received in the respective holes. The skirt is supported by the plug member before the jack member is inserted into the plug member, and holds the pin-like male contacts in an accurate position. Accordingly, it is possible to insert the jack member into the plug member with the pin-like male contacts held in an accurate position.

In one example of this prior art reference, a stopper is arranged in the plug member for limiting an upper limit position of the skirt, and a spring urges the skirt toward the stopper, so that the skirt can move between the upper limit position and the bottom of the plug member. When the jack member is inserted into the plug member, the skirt is pushed by the jack member and moves downwardly and the female contacts of the jack member are fit over the pin-like male contacts. When the jack member is withdrawn from the plug member, the skirt returns to the initial upper limit position by the action of the spring.

In another example of this prior art reference, the skirt and the jack member have interengaging structures so that the skirt follows the movement of the jack member during insertion and withdrawal thereof. Also, a recess is formed on the side of the skirt and a projection is formed on the plug member to maintain the skirt at the upper limit position. However, this prior art does not clearly describe the mechanism by which the engagement between the skirt and the jack member, and between the skirt and the plug member can be effected only by the movement of the jack member during insertion and withdrawal thereof.

In widely known connectors comprising a plug member and a jack member, the plug member has a housing having an inner surface used as a guide surface, and the jack member has a housing having an outer surface, so that the jack member is inserted into the plug member while the outer surface of the jack member slides along the inner surface of the plug member. The relationship between the outer surface of the jack member and the inner surface of the plug member corresponds to the relationship between the female contacts of the jack member and the pin-like male contacts of the plug member, so the female contacts are naturally fit over the pin-like male contacts by simply inserting the jack member into the plug member.

However, in the above described prior art reference, the jack member is not inserted along the inner surface of the plug member, and means for locating the jack member relative to the plug member is not shown. Therefore, a problem arises in that a considerable time must be consumed to insert the jack member into the plug member, irrespective of the fact that the skirt holds the pin-like male contacts in an accurate position.

Also, in the case where the jack member is inserted into the plug member while the outer surface of the jack member slides along the inner surface of the plug member, there is necessarily a clearance between the outer surface of the jack member and the inner surface of the plug member. Thus a problem arises in that if the cross-sectional area and the pitch of the pin-like male contacts becomes narrower, the pin-like male contacts of the plug member cannot be always accurately aligned with the female contacts of the jack member, even in the structure where the outer surface of the jack member is guided along the inner surface of the plug member.

SUMMARY OF THE INVENTION

The object of the present invention is to provide a connector comprising a skirt to hold the pin-like male contacts of the plug member in an accurate position and wherein the pin-like male contacts of the plug member can be accurately aligned with the female contacts of the jack member when the jack member is inserted into the plug member.

According to the present invention, there is provided a connector comprising a plug member having a plurality of pin-like male contacts having free end portions, a jack member having a plurality of female contacts for engagement with the pin-like male contacts, and a skirt movably arranged in the plug member so that the skirt can be pushed by the jack member when the jack member is inserted into the plug member, the skirt having a plurality of holes for receiving the pin-like male contacts, respectively, and to hold the free end portions of the pin-like male contacts before the jack member is inserted into the plug member. In this arrangement, the plug member has at least one locking groove means for supporting the skirt in a predetermined position, the skirt having at least one locking wall means engageable with the locking groove means of the plug member, the jack member having at least one engaging wall means engageable with the locking wall means of the skirt to release the engagement of the locking wall means from the locking groove means when the jack member is inserted into the plug member. In addition, the skirt has an alignment pin and the jack member has a locating hole to receive the alignment pin.

With this arrangement, the skirt holds the pin-like male contacts of the plug member in an accurate position. This skirt has the alignment pin which is received by the locating hole of the jack member. Therefore, the jack member can be accurately aligned with the skirt. On the other hand, the skirt is aligned with the plug member due to the contact-hold engagement. The jack member is thus aligned with the plug member via the skirt. Therefore, the female contacts can be smoothly fit over the pin-like male contacts when the jack member is inserted into the plug member.

Also, the plug member has the locking groove means for supporting the skirt at a predetermined position, and the skirt has the locking wall means engageable with the locking groove means of the plug member. Therefore, the skirt can accurately hold the free end portions of the pin-like male contacts before the jack member is inserted into the plug member. Also, the jack member has the engaging wall means engageable with the locking wall means of the skirt to release the engagement of the locking wall means from the locking groove means when the jack member is inserted into the plug member. Therefore, the jack member can be inserted into the plug member with the jack member aligned with the skirt by the alignment pin-hole engagement, and the jack member advances and pushes the skirt so that the female contacts are fit over the revealed pin-like male contacts.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
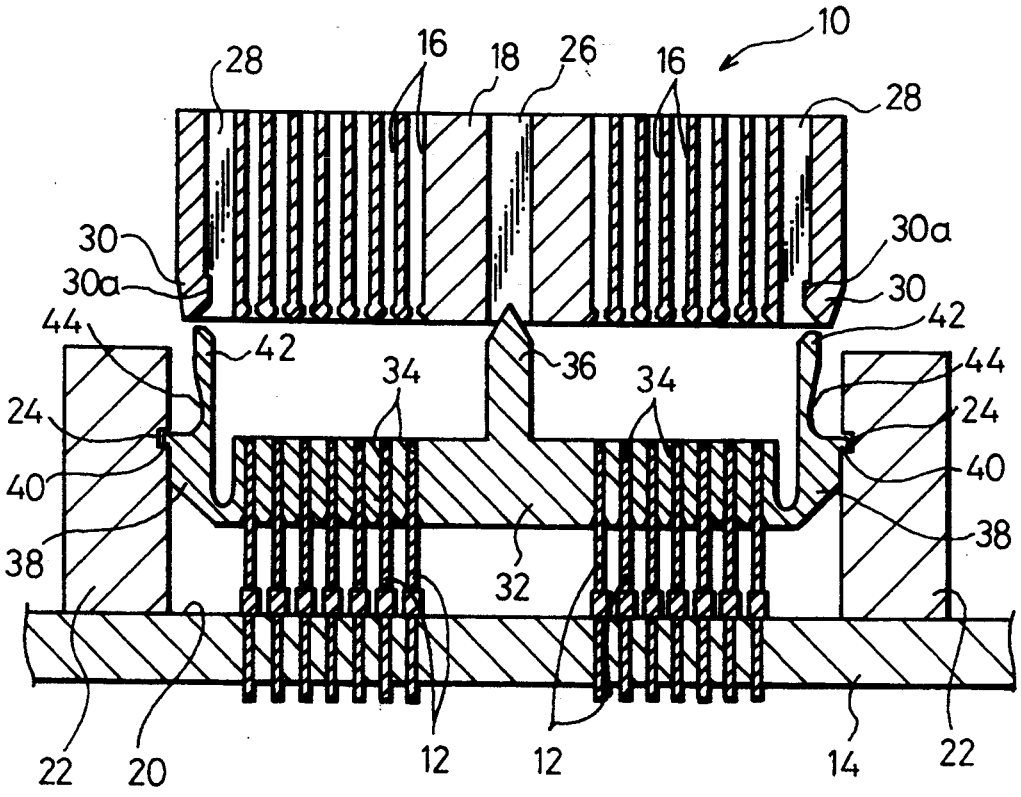
FIG. 1 is a cross-sectional view of a connector according to the embodiment of the present invention.
Figure 4:
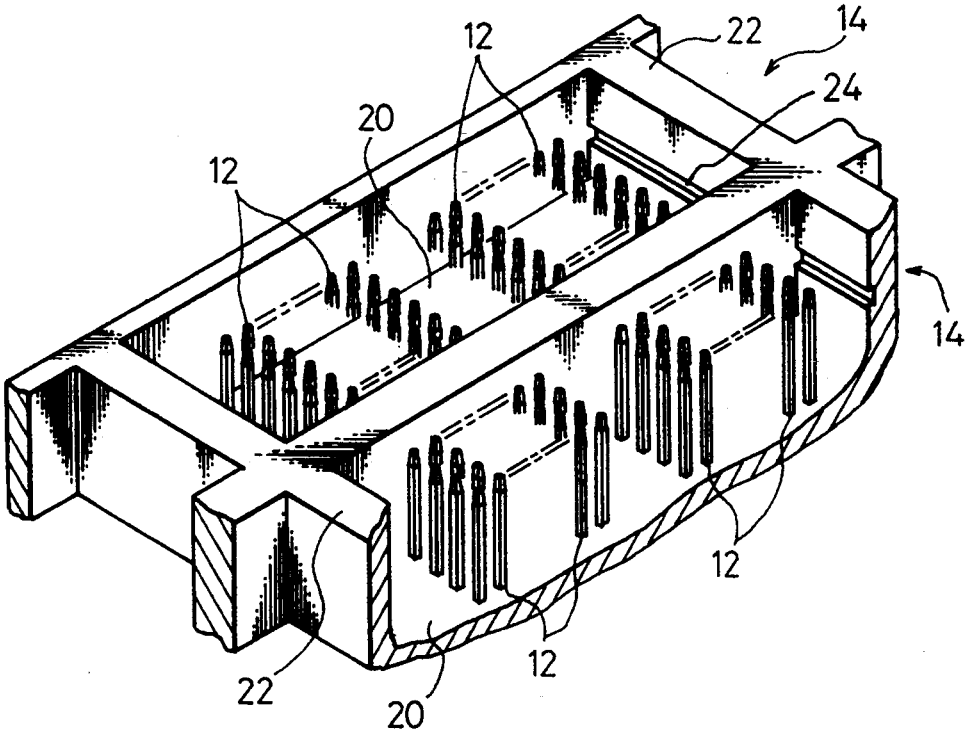
FIG. 4 is a perspective view of a mother board incorporating the plug member of FIG. 1.

FIG. 1 shows the embodiment of the present invention. The connector comprises a plug member 14 having a plurality of pin-like male contacts 12, and a jack member 18 having a plurality of female contacts 16 for engagement with the pin-like male contacts 12. As shown in FIG. 4, the plug member 14 comprises, for example, a portion of a mother board of a computer. Alternatively, the plug member 14 can be attached to a printed wiring board. The plug member 14 comprises a bottom wall portion 20 having the pin-like male contacts 12 fixed thereto, and an annular wall portion 22 surrounding the pin-like male contacts 22. Locking grooves 24 are arranged on the opposite inner surfaces of the annular wall portion 22, the locking grooves 24 extending in parallel to the bottom wall portion 20.

Figure 3:
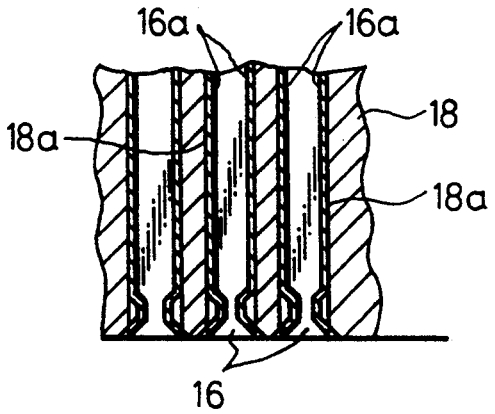
FIG. 3 is a partial detailed view of the jack member of FIG. 1.

As shown in FIG. 3, the female contacts 16 of the jack member 18 comprise conductive pieces **16*a* arranged on the surfaces of holes 18*a* in the jack member 18. Therefore, an electrical connection is established if the pin-like male contacts 22 contact the female contacts 16**.

Figure 6:
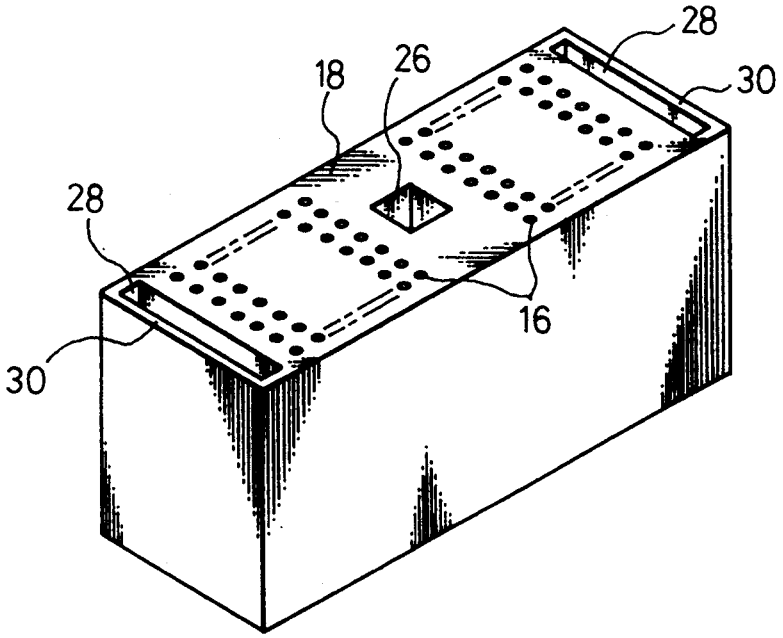
FIG. 6 is a bottom perspective view of the jack member of FIG. 1.

As shown in FIGS. 1 and 6, the jack member 18 has locating hole 26 at the center thereof, and elongated apertures 28 at the opposite ends thereof. The outer side edges of the elongated apertures 28 constitute engaging wall means 30.

According to the present invention, the connector 10 includes a skirt 32. The skirt 32 has a plurality of holes 34 for receiving the pin-like male contacts 12, respectively, to hold the free end portions of the pin-like male contacts 12 before the jack member 18 is inserted into the plug member 14. In FIG. 1, the skirt 32 is supported by the plug member 14 and holds the pin-like male contacts 12. The skirt 32 is movably supported by the plug member 14 so that the skirt 32 can be pushed by the jack member 18 when the jack member 18 is inserted into the plug member 14.

Figure 5:
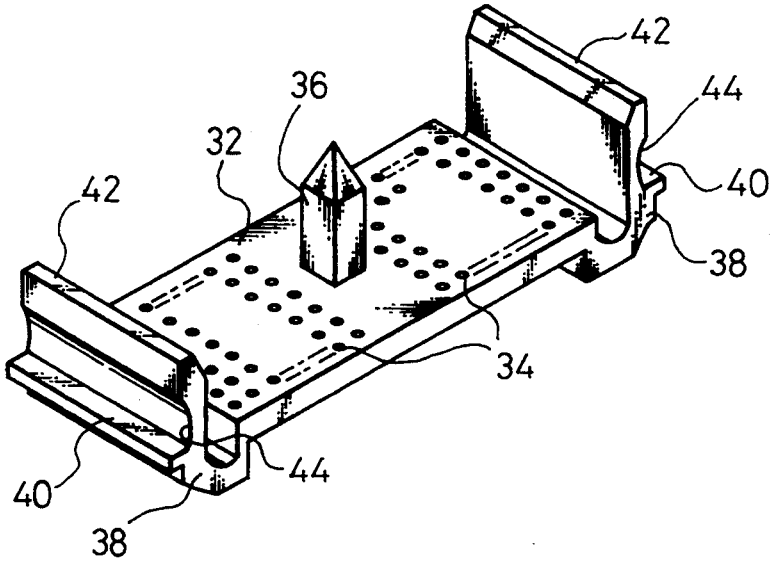
FIG. 5 is a perspective view of the skirt of FIG. 1.

As shown in FIGS. 1 and 5, the skirt 32 comprises a substantially flat plate having the holes 34 and has an alignment pin 36 at the center thereof. The alignment pin 36 has a rectangular cross-section and a sharpened tip. The alignment pin 36 is fit in the locating hole 26 of the jack member 18, which also has a rectangular cross-section.

The skirt 32 has flocking walls 38 at the opposite ends thereof. Each of the locking walls 38 comprises an elastically deformable portion integrally formed with the plate of the skirt 32 and laterally extending toward the annular wall portion 22 of the plug member 14. In particular, each of the locking walls 38 comprises a first tongue 40 extending outwardly toward the annular wall portion 22 of the plug member 14 to engage with the locking groove 24 of the plug member 14, and a second tongue 42 extending in the opposite direction from the bottom wall portion 20 of the plug member 14 to engage with the engaging wall means 30 of the jack member 18.

The first tongue 40 of the locking wall portion 38 engages with the locking groove 24 of the plug member 14. The first tongue 40 can be pushed and elastically deformed by the engaging wall means 30 of the jack member 18 when the jack member 18 is inserted into the plug member 14, thus the first tongue 40 is disengaged from the locking groove 24. The first tongue 40, or a portion of the locking wall portion 38 below the first tongue 40 can then slide along the inner surface of the annular wall portion 22 of the plug member 14 after the first tongue 40 is disengaged from the locking groove 24. That is, the skirt 32 is normally in contact with the plug member 14.

The second tongue 42 has a tapered portion 44, and the engaging wall means 30 of the jack member 18 engaging with the second tongue 42 has small projection **30*a*. Accordingly, the skirt 32 is pulled back into the plug member 14 when the jack member 18 is withdrawn from the plug member 14, and the skirt 32 alone can be withdrawn from the plug member 14 after the first tongue 40 is supported in the locking groove 24 at the initial holding position of the pin-like male contacts 12**.

In operation, the skirt is supported by the plug member 14, as shown in FIG. 1. In this condition, the pin-like male contacts 12 of the connector 10 are held by the holes 34 of the skirt 32, respectively, and the first tongue 40 of the locking wall 38 of the skirt 32 engages with the locking groove 24 of the plug member 14.

The jack member 18 is then inserted into the plug member 14. FIG. 1 shows the initial condition of the insertion of the jack member 18, and the alignment pin 36 first engages with the locating hole 26.

Figure 2:
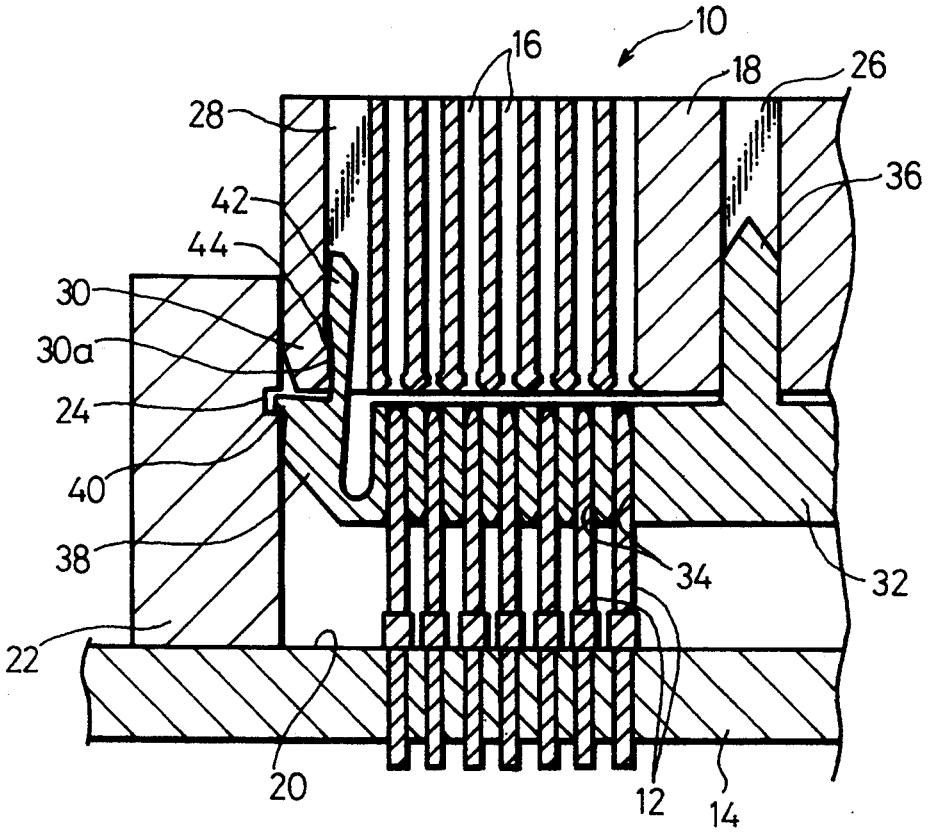
FIG. 2 is cross-sectional view similar to FIG. 1 but showing the jack member further inserted from the position of FIG. 1.

FIG. 2 shows the condition where the jack member 18 is further inserted in the plug member 14. The second tongue 42 enters the elongated aperture 28 of the jack member 18. The engaging wall means 30 of the jack member 18 has a tapered tip which can be inserted into a gap between the annular wall portion 22 and the second tongue 42, and the second tongue 42 is forcibly opened to a small extent. Accordingly, the first tongue 40 moves in the locking groove 24 in the releasing direction but is slightly engaged with the locking groove 24 until the leading edge of the engaging wall means 30 reaches the step between the first and second tongues 40 and 42.

When the jack member 18 is further inserted from the position of FIG. 2, the leading edge of the engaging wall means 30 contacts the step between the first and second tongues 40 and 42, and pushes the skirt 32, with the result that the first tongue 40 is disengaged from the locking groove 24. In this instance, the first tongue 40, or a portion of the locking wall portion 38 below the first tongue 40 slides along the inner surface of the annular wall portion 22 of the plug member 14.

As the jack member 18 is further inserted, the engaging wall means 30 pushes the skirt 32 in the plug member 14 and so the female contacts 16 are fit over the revealed pin-like male contacts 12. In this way, the plug-in connection between the plug member 14 and the jack member 18 is completed. The jack member 18 is aligned with the plug member 14 via the skirt 32 and so the female contacts 16 can be smoothly fit over the pin-like male contacts 12, since the jack member 18 is accurately aligned with the skirt 32 by the alignment pin 36 and the skirt 32 is aligned with the plug member 14.

In the condition where the jack member 18 is inserted into the plug member 14, the projection 30*a* of the engaging wall means 30 engages with the tapered portion 44 of the second tongue 42, in a manner similar to that shown in FIG. 2. Therefore, when the jack member 18 is withdrawn from the plug member 14, the skirt 32 follows the withdrawing movement of the jack member 18. Therefore, the first tongue 40 is supported by the locking groove 24 when the skirt 32 reaches the holding position of the pin-like male contacts 12 of FIG. 2. The skirt 32 no longer follows the jack member 18, and the jack member 18 can be solely withdrawn.

As explained above in detail, according to the present invention, it is possible to insert the Jack member into the plug member without the pin-like male contacts being bent, as well as to easily withdraw the jack member from the plug member.

We claim:

1. A connector comprising:

a plug member having a plurality of pin-like male contacts having free end portions;

a jack member having a plurality of female contacts for engagement with the pin-like male contacts; and a skirt movably arranged in the plug member so that the skirt can be pushed by the jack member when the jack member is inserted into the plug member, the skirt having a plurality of holes for receiving the pin-like male contacts, respectively, and to hold the free end portions of the pin-like male contacts before the jack member is inserted into the plug member;

wherein the plug member has at least one locking groove means for supporting the skirt at a predetermined position, the skirt having at least one locking wall means engageable with the locking groove means of the plug member, the jack member having at least one engaging wall means engageable with the locking wall means of the skirt to release the engagement of the locking wall means from the locking groove means when the jack member is inserted into the plug member;

wherein the skirt has an alignment pin and the jack member has a locating hole to receive the alignment pin;

wherein the plug member comprises a bottom wall portion having the pin-like male contacts fixed thereto, and an annular wall portion surrounding the pin-like male contacts, the annular wall portion having an inner surface and the locking groove means being arranged on the inner surface, and the skirt comprises a generally flat plate, the locking wall means comprising an elastically deformable portion integrally formed with the plate and laterally extending toward the annular wall portion, whereby the locking wall means is disengaged from the locking groove means, with the elastically deformable portion being pushed and deformed by the engaging wall means of the jack member when the jack member is inserted into the plug member;

wherein the locking wall means slides along the inner surface of the annular wall portion of the plug member after the locking wall means is disengaged from the locking groove means; and wherein the locking wall means comprises a first tongue extending outwardly toward the annular wall portion of the plug member to engage with the locking groove means, and a second tongue extending in the opposite direction from the bottom wall portion of the plug member to engage with the engaging wall means of the jack member.

2. A connector according to claim 1 wherein the locking wall means and the engaging wall means are formed so that the locking wall means is disengaged from the locking groove means when the jack member is inserted into the plug member, so that the skirt is pushed into the plug member as the jack member is further inserted into the plug member, and so that the skirt is pulled back into the plug member to bring the locking wall means into engagement with the locking groove means at said predetermined position when the jack member is withdrawn from the plug member.

3. A connector according to claim 1, wherein the plug member comprises a bottom wall portion having the pin-like male contacts fixed thereto, and an annular wall portion surrounding the pin-like male contacts, the annular wall portion having an inner surface and the locking groove means being arranged on the inner surface, and the skirt comprises a generally fiat plate, the locking wall means comprising an elastically deformable portion integrally formed with the plate and laterally extending toward the annular wall portion, whereby the locking wall means is disengaged from the locking groove means, with the elastically deformable portion being pushed and deformed by the engaging wall means of the jack member when the jack member is inserted into the plug member.

4. A connector according to claim 1, wherein the locking wall means slides along the inner surface of the annular wall portion of the plug member after the locking wall means is disengaged from the locking groove means.

5. A connector according to claim 1, wherein at least one of the engaging wall means of the jack member and the second tongue comprises a tapered engaging portion allowing the skirt to be pulled back when the jack member is withdrawn from the plug member and allowing only the jack member to be pulled off the plug member after the first tongue is engaged with the locking groove means at said predetermined position when jack member is withdrawn from the plug member.

6. A connector according to claim 1, wherein the alignment pin is first received in the locating hole and subsequently the female contacts are engaged with the pin-like male contacts, when the jack member is inserted into the plug member.

7. A connector according to claim 1, wherein the alignment pin is arranged generally at the center of the skirt of the locating hole is arranged generally at the center of the jack member.

8. A connector according to claim 1, wherein the alignment pin has a polygonal cross-sectional shape, and the locating hole has a polygonal cross-sectional shape complementary to the shape of the alignment pin.

9. A connector comprising:

a plug member having a bottom wall portion, a plurality of pin-like male contacts fixed to the bottom wall portion and having free ends portions, and an annular wall portion surrounding the pin-like male contacts, the annular wall portion having an inner surface;

a jack member having a plurality of female contacts for engagement with the pin-like male contacts; and a generally flat skirt including an elastically deformable portion integrally formed with the skirt and laterally extending toward the annular wall portion, the skirt movably arranged in the plug member so that the skirt can be pushed by the jack member when the jack member is inserted in the plug member, the skirt having a plurality of holes for receiving the pin-like male contacts, respectively, to hold the free end portions of the pin-like male contacts before the jack member is inserted in the plug member;

wherein the plug member has at least one locking groove means for supporting the skirt at a predetermined position, the skirt having at least one locking wall means engageable with the locking groove means of the plug member, the jack member having at least one engaging wall means engageable with the locking wall means of the skirt to release the engagement of the locking wall means from the locking groove means when the jack member is inserted in the plug member;

wherein the locking wall means comprises a first tongue extending outwardly toward the annular wall portion of the plug member to engage with the locking groove means, and a second tongue extending in the opposite direction from the bottom wall portion of the plug member to engage with the engaging wall means of the jack member; and wherein the skirt has an alignment pin and the jack member has a locating hole to receive the alignment pin.

* * * * *

UNITED STATES PATENT AND TRADEMARK OFFICE

CERTIFICATE OF CORRECTION

PATENT NO. : 5,437,558

DATED : Aug. 1, 1995

INVENTOR(S) : SAKURAOKA et al.

It is certified that error appears in the above-indentified patent and that said Letters Patent is hereby corrected as shown below:

Col. 5, line 61, change "Jack" to --jack--.

Col. 6, line 68, change "fiat plate" to --flat plate--.

Col.7, line 39, change "ends portions" to --end portions--.

Signed and Sealed this

Twelfth Day of December, 1995

*Attest:*

*Attesting Officer*

BRUCE LEHMAN

*Commissioner of Patents and Trademarks*